US006215080B1

(12) United States Patent
Mori et al.

(10) Patent No.: US 6,215,080 B1
(45) Date of Patent: Apr. 10, 2001

(54) SWITCH DEVICE WITH AC INLET AND AC SWITCH

(75) Inventors: Toshiharu Mori; Masayuki Takeda; Yoshimi Goto; Yoshio Tanabe, all of Miyagi-ken (JP)

(73) Assignee: Alps Electric Company, Tokyo (JP)

( * ) Notice: Subject to any disclaimer, the term of this patent is extended or adjusted under 35 U.S.C. 154(b) by 0 days.

(21) Appl. No.: 09/621,016

(22) Filed: Jul. 21, 2000

(30) Foreign Application Priority Data

Jul. 26, 1999 (JP) ..... 11-210533
Jul. 26, 1999 (JP) ..... 11-210536

(51) Int. Cl.[7] ..... H01H 9/00
(52) U.S. Cl. ..... 200/51 R; 200/51.11
(58) Field of Search ..... 200/51 R–51.13, 200/284, 334

(56) References Cited

U.S. PATENT DOCUMENTS 3,723,679 * 3/1973 Carney ..... 200/50 B
4,256,935 * 3/1981 Ito et al. ..... 200/51 R
4,485,282 * 11/1984 Lee ..... 200/51 R
4,930,047 * 5/1990 Peterson ..... 361/395
6,062,886 * 5/2000 Chen ..... 439/188

FOREIGN PATENT DOCUMENTS 08007559A 1/1996 (JP) ..... G11B/33/12

* cited by examiner

*Primary Examiner*—Michael Friedhofer
(74) *Attorney, Agent, or Firm*—Brinks Hofer Gilson & Lione

(57) ABSTRACT

A connecting structure in a switch device with AC inlet is disclosed wherein, when terminals of the switch device are connected together using a thin metallic connecting strip, there is no fear of an external force on the terminals causing damage to the connection between the terminals and the connecting strip and resulting in unstable contact, and which, even at different thermal expansion coefficients in a power ON condition, ensures a stably held state of the connecting strip and can afford excellent assemblability and reliability of connection. The input device comprises AC inlets having a connecting pin for AC input and also having an inlet terminal for connection, an AC switch having a connecting-side terminal and an output-side terminal, a metallic connecting strip for electrically connecting the inlet terminal of the AC inlets with the connecting-side terminal of the AC switch, and a bracket with the AC inlets and the AC switch attached thereto, the connecting strip being formed of a flat metallic strip and having a bent portion at an intermediate position of the connection between the inlet terminal and the connecting-side terminal of the AC switch.

4 Claims, 6 Drawing Sheets

SWITCH DEVICE WITH AC INLET AND AC SWITCH

BACKGROUND OF THE INVENTION

1. Field of the Invention

The present invention relates to a switch device having an AC inlet and an AC switch which are accommodated within a common bracket. Particularly, the invention is concerned with a connecting structure for connecting terminals electrically with each other.

2. Description of the Prior Art

As conventional switch devices in which an AC inlet and an AC switch are accommodated within a common bracket there are generally known a switch device in which a common bracket formed of an insulating material such as a synthetic resin is provided with receptacle portions, and an AC inlet and an AC switch are fitted in those receptacle portions respectively, and a switch device in which a bracket is allowed to also serve as an insulating base of an AC inlet, and an AC switch is attached thereto.

As methods for connecting the AC inlet and the AC switch in such switch device equipped with AC inlet there generally are known a method in which lead wires or the like are soldered to the respective terminals and a method in which both are connected together using a printed circuit board with a connecting pattern printed thereon. In both methods, however, for ensuring the distance of an energized portion defined by the electric appliance and material control law and also by safety standards in various countries, an external size of the bracket increases in the thickness direction, thus making it difficult to follow the tendency to the reduction of thickness. Moreover, in case of using a printed circuit board, an increase of cost results.

As a method proposed recently for the connection of AC inlet and AC switch there is known a method in which a connecting strip serving as a conductive portion is formed using a thin metallic strip such as a thin steel or brass strip and terminals are connected together through the said connecting strip. According to this method using such a connecting strip, it becomes possible to thin the terminals to be connected and the assembly is easy, so that the reduction of cost can be attained.

In the above structure of the conventional switch device with AC inlet, however, in case of connecting the terminal of the AC inlet and that of the AC switch with each other by using the connecting strip, since the connection with the connecting strip is a solid connection made by caulking or soldering, the connection is deficient in flexibility. Particularly, since an attachment plug for the supply of an alternating current from an external power supply is inserted and pulled out with respect to the terminal of the AC inlet, an external force is exerted on the terminal, giving rise to the problem that the connection between the terminal and the connecting strip is damaged or an unstable contact results.

Further, in the case where the material of the AC inlet and AC switch terminals and that of the connecting strip are of different kinds, a stress is imposed on the terminals due to a difference in thermal expansion coefficient when power is ON, resulting in damage of the connection between the terminals and the connecting strip or the occurrence of a crack. In this case, the connecting strip becomes unstable in its held state and there remains a problem to be solved in point of assemblability and reliability of connection.

SUMMARY OF THE INVENTION

Accordingly, it is an object of the present invention to solve the above-mentioned problems and provide a connecting structure in a switch device with AC inlet wherein, when terminals of the switch device are connected together using a thin metallic connecting strip, there is no fear of an external force on the terminals causing damage to the connection between the terminals and the connecting strip and resulting in unstable contact, and which, even at different thermal expansion coefficients in a power ON condition, ensures a stably held state of the connecting strip and can afford excellent assemblability and reliability of connection.

For solving the above-mentioned problems, in the first aspect of the present invention there is provided a switch device comprising an AC inlet having a connecting pin for AC input and an inlet terminal for connection, an AC switch having a connecting-side terminal and an output-side terminal, a metallic connecting strip for electrically connecting the inlet terminal of the AC inlet and the connecting-side terminal of the AC switch with each other, and a bracket with the AC inlet and AC switch attached thereto, wherein the connecting strip is formed of a flat metallic strip and has a bent portion at an intermediate position of the connection between the inlet terminal and the connecting-side terminal of the AC switch.

In the second aspect of the present invention, the bent portion of the connecting strip is bent in a generally U shape in the thickness direction of the connecting strip to permit longitudinal expansion and contraction of the connecting strip.

In the third aspect of the present invention, the bottom of the generally U-shaped bent portion of the connecting strip and the vicinity thereof are formed thin to provide a thin-wall portion.

In the fourth aspect of the present invention, the bracket is formed with a holding portion for abutment against the connecting strip to hold the connecting strip.

DETAILED DESCRIPTION OF A PREFERRED EMBODIMENT

Figure 1:
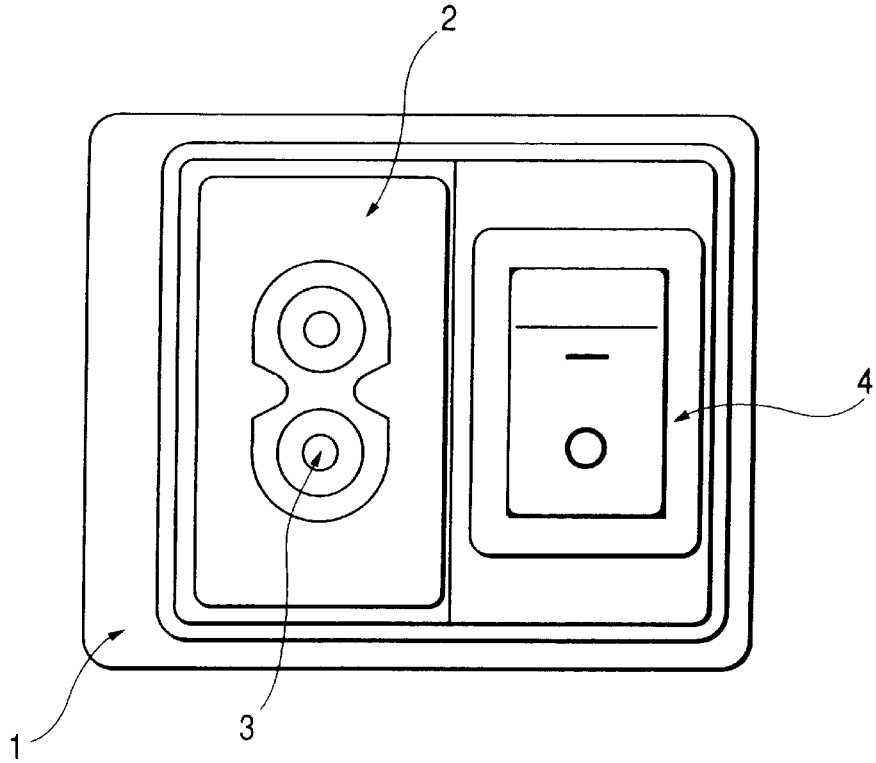
FIG. 1 is a plan view of a switch device with AC inlet according to an embodiment of the present invention.
Figure 2:
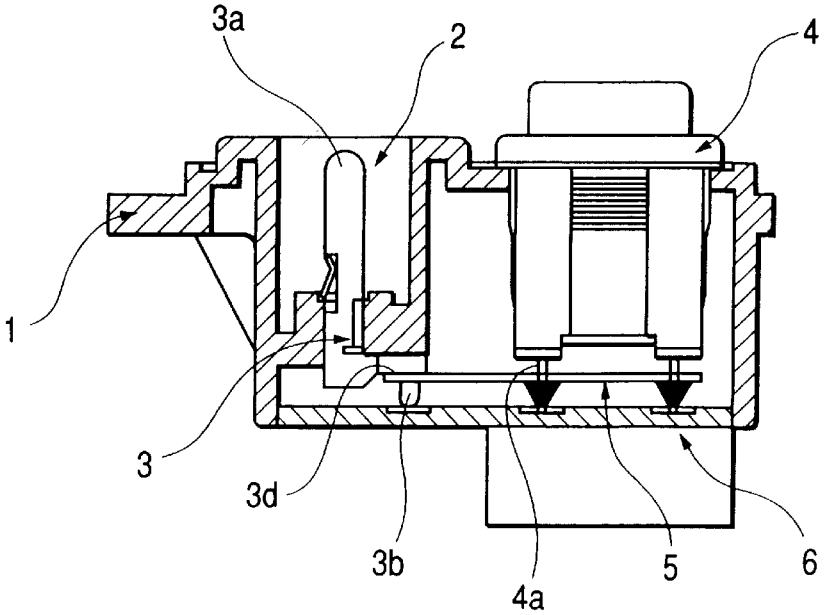
FIG. 2 is a vertical sectional view thereof.
Figure 3:
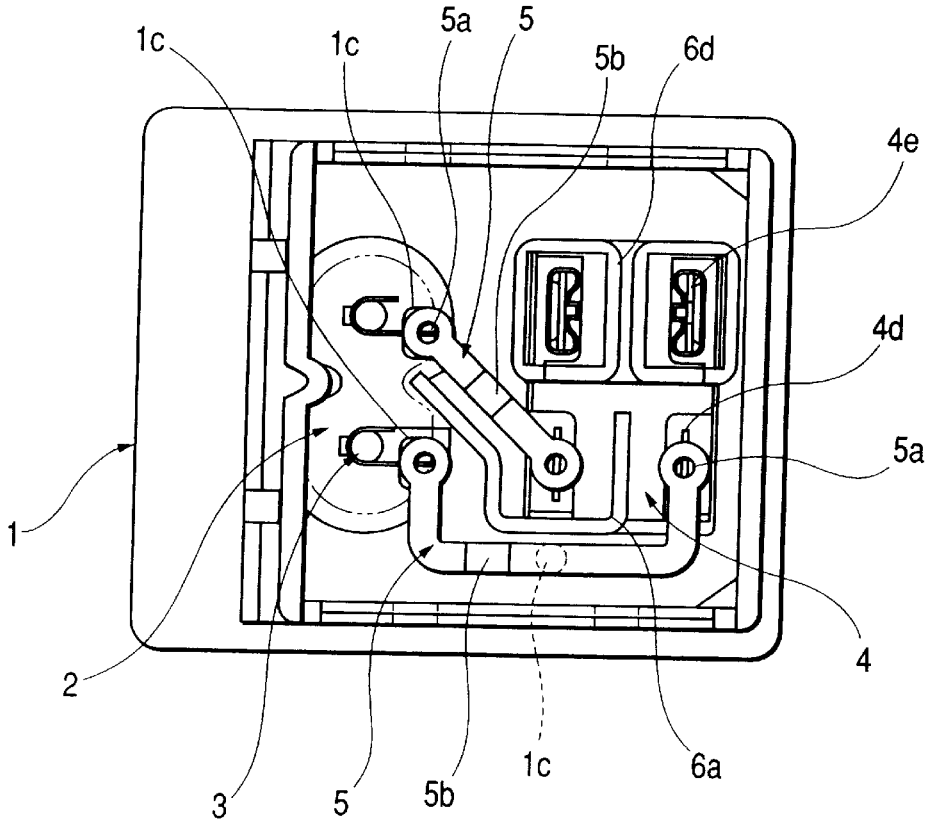
FIG. 3 is an explanatory diagram showing a connected state of connecting strips according to the invention.
Figure 4:
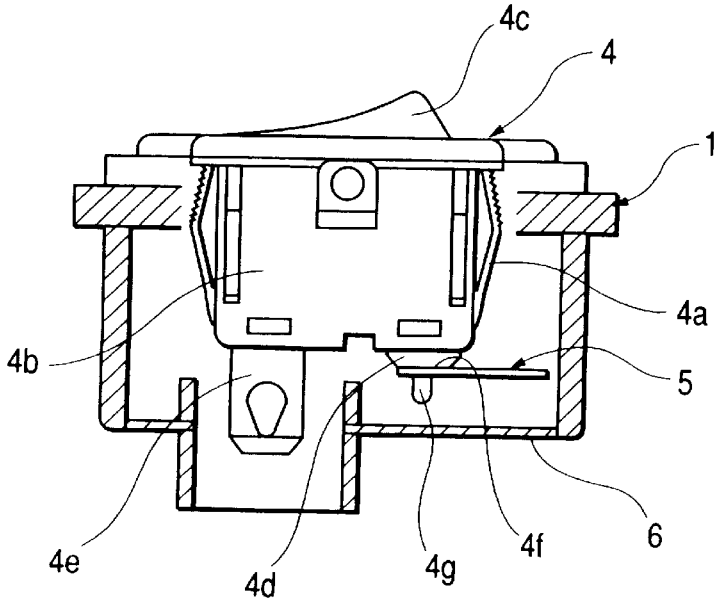
FIG. 4 is a sectional view showing a mounting portion for mounting an AC switch according to the invention.
Figure 5:
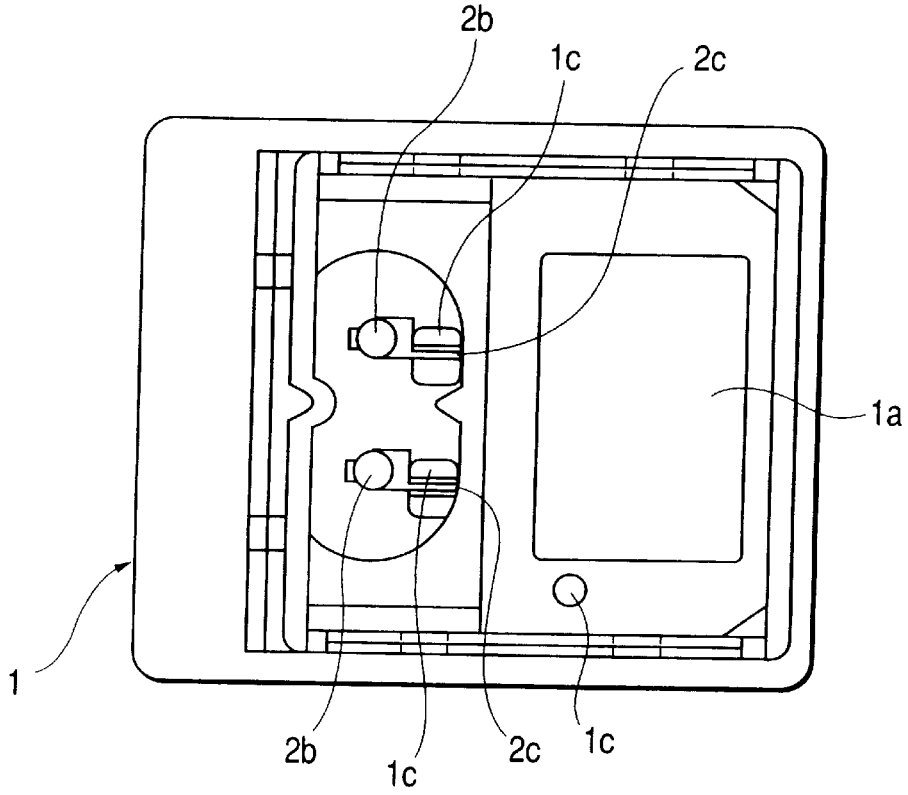
FIG. 5 is a bottom view of a bracket according to the invention.
Figure 6:
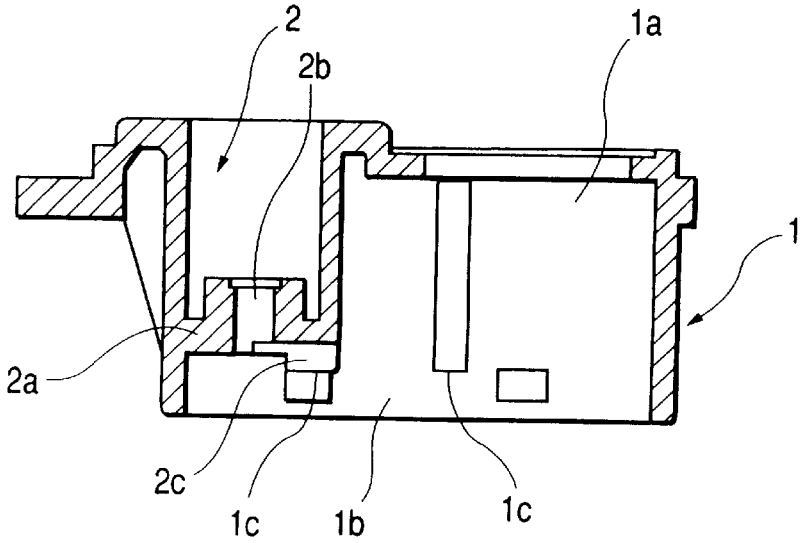
FIG. 6 is a vertical sectional view thereof.
Figure 7:
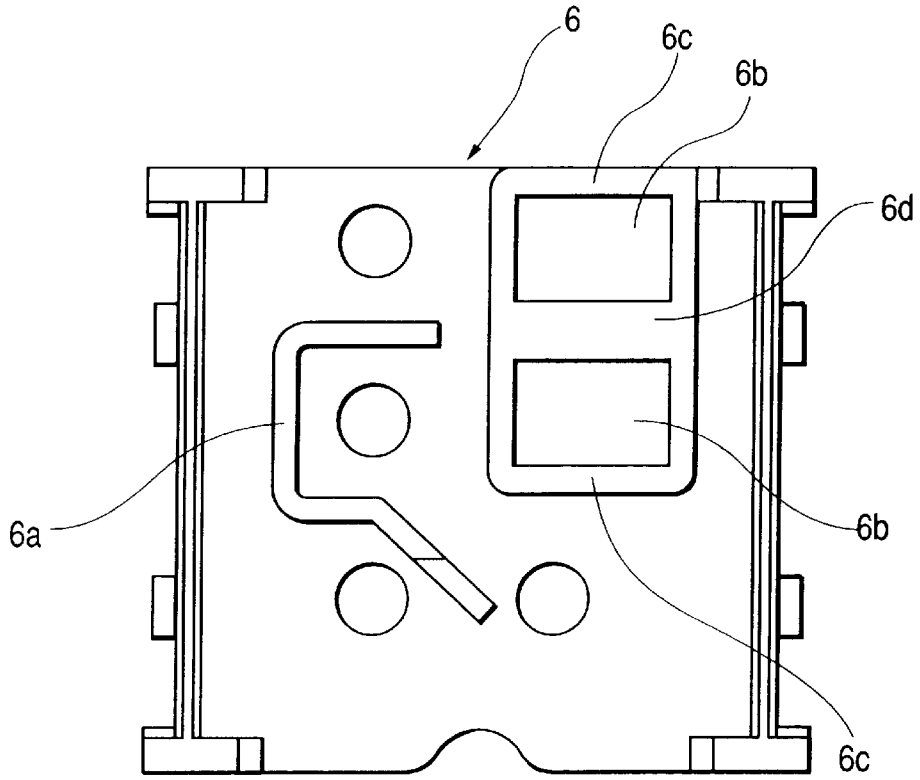
FIG. 7 is a plan view of an insulating cover according to the invention.
Figure 8:
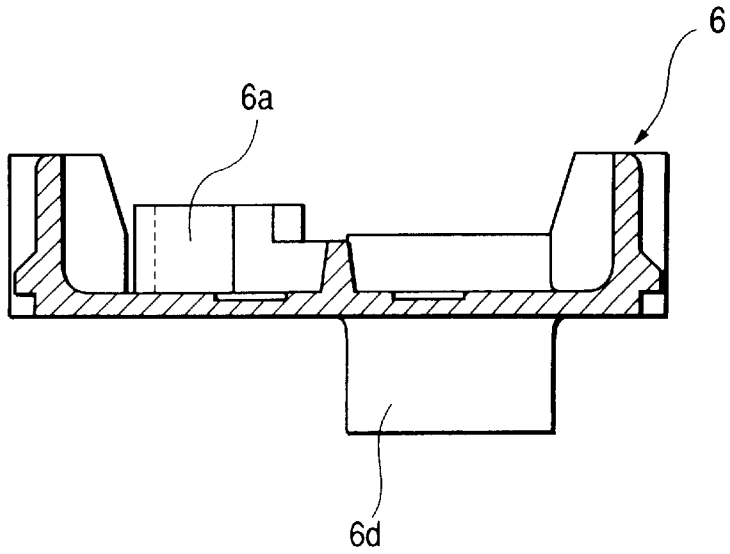
FIG. 8 is a vertical sectional view thereof.
Figure 9:
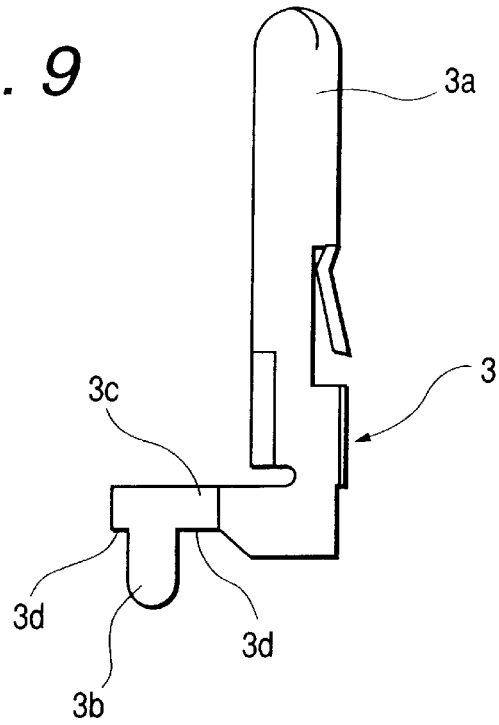
FIG. 9 is a front view of an inlet terminal according to the invention.
Figure 10:
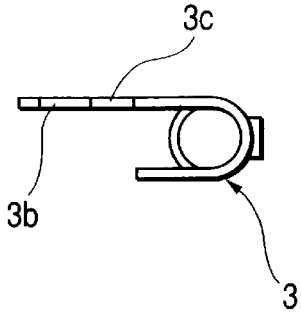
FIG. 10 is a bottom view thereof.
Figure 11:
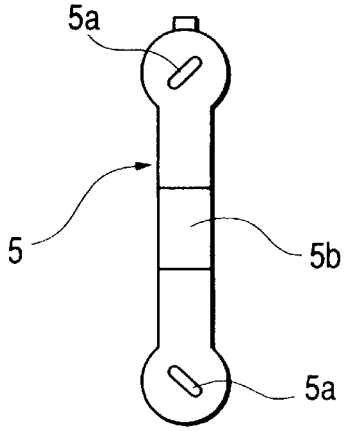
FIG. 11 is a plan view of a connecting strip according to the invention.
Figure 12:
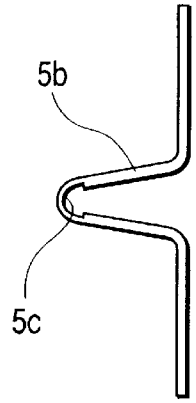
FIG. 12 is a side view thereof.
Figure 13:
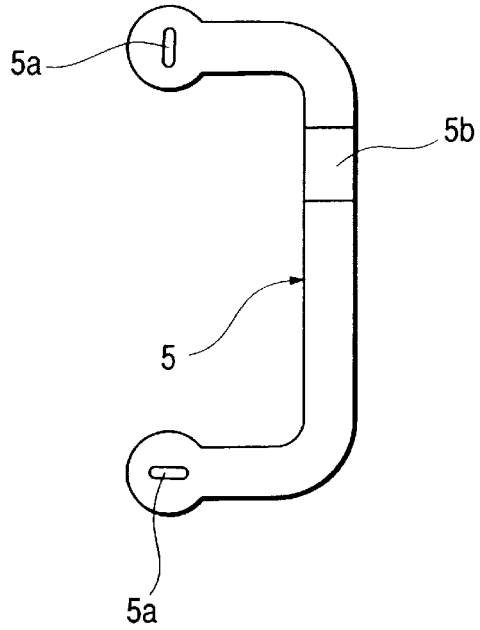
FIG. 13 is a plan view of another connecting strip.
Figure 14:
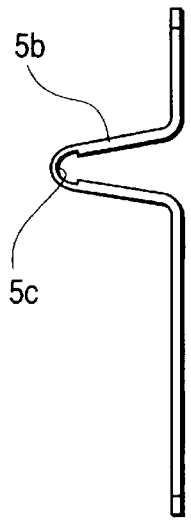
FIG. 14 is a side view thereof.

An embodiment of the present invention will be described in detail hereunder with reference to FIGS. 1 to 14, of which FIG. 1 is a plan view of a switch device with AC inlet embodying the present invention, FIG. 2 is a vertical sectional view thereof, FIG. 3 is an explanatory diagram showing a connected state of connecting strips, FIG. 4 is a sectional view showing a mounting portion for an AC switch, FIG. 5 is a bottom view of a bracket, FIG. 6 is a vertical sectional view thereof, FIG. 7 is a plan view of an insulating cover, FIG. 8 is a vertical sectional view thereof, FIG. 9 is a front view of an inlet terminal, FIG. 10 is a bottom view thereof, FIG. 11 is a plan view of a connecting strip, FIG. 12 is a side view thereof, FIG. 13 is a plan view of another connecting strip, and FIG. 14 is a side view thereof.

In these figures, a bracket 1 is formed in a generally box shape using an insulating material such as a synthetic resin. On the left-hand side of the bracket 1 in the figures is integrally formed an insulating base 2 of an AC inlet into which is inserted an attachment plug (not shown) for the supply of an alternating current from an external power supply. The insulating base 2 is formed in a box shape having a bottom portion 2*a* whose upper side is open. In the bottom portion 2*a* are formed a pair of through holes 2*b*. An inlet terminal 3 formed of an electrically conductive metallic material such as brass and having a connecting pin 3*a* whose tip end is formed in a rod shape, is fixed into each through hole 2*b* by a suitable method such as press-fitting.

On the opposite end side of the connecting pin 3*a* in the inlet terminal 3 is formed a connecting piece 3*b* for connection with a connecting strip to be described later, the connecting piece 3*b* being extended outside of the bottom portion 2*a*. The connecting piece 3*b* is positioned so as to be offset outside relative to the position of each through hole 2*b* which position is the mounting position of the inlet terminal 3. By so doing, the through hole 2*b* in the bracket 1 located in the mounting position of the inlet terminal 3 is prevented from being deformed by heat generated at the time of soldering the connecting piece 3*b* and a connecting strip with each other.

The inlet terminal 3 is formed with an arm portion 3*c* extended in the shape of a strip from a base portion of the inlet terminal and having a flexible distal end. At the distal end of the arm portion 3*c* is formed a position restricting stepped portion 3*d*, with the connecting piece 3*b* as an upright piece being formed on the stepped portion 3*d*. At one end of the connecting pin 3*a* the arm portion 3*c* extends in a direction orthogonal to the axis of the connecting pin. The arm portion 3*c* is brought into abutment against a lower side of the bottom 2*a* of the bracket 1 to prevent dislodgment in the projecting direction of the connecting pin 3*a*.

In the lower surface of the bottom portion 2*a* is formed a slot 2*c* contiguously to each through hole 2*b*. An inner width of the slot 2*c* is set somewhat wide so that the arm portion 3*c* is movable within the range of the slot 2*c*. When the inlet terminal 3 is inserted into the through hole 2*b*, the arm portion 3*c* is restricted its position by the slot 2*c*, whereby it becomes easy to effect the mounting. After the mounting, a free end of the arm portion moves within the range of the slot 2*c* and therefore any excessive external force is exerted on the connection with the connecting strip to be described later, that is, it is possible to prevent damage of the connection.

The inlet terminal 3 is integrally formed into a generally L shape by cutting or bending with use of an electrically conductive metallic material. The connecting pin 3*a* is formed in a rod shape of a round section and is press-fitted into a connecting terminal (not shown) of an attachment plug such as a cord for the supply of electric power from an external power supply.

On the right-hand side of the bracket 1 in the figures is formed an AC switch receptacle portion 1*a* in an opposed relation to the insulating base 2 of the AC inlet, the AC switch receptacle portion 1*a* being open to an upper surface of the bracket 1. Within the AC switch receptacle portion 1*a* is mounted an AC switch 4 of a seesaw type. The AC switch 4 is mounted to the bracket 1 by snap-in fitting through a pair of mounting pieces 4*a* formed respectively on both sides of the AC switch 4.

The AC switch 4 is an existing seesaw type power switch and is formed in a box shape using an insulating material such as a synthetic resin. The AC switch 4 is made up of a case 4*b* having the mounting pieces 4*a* on both sides thereof, an operating knob 4*c* disposed on an upper surface of the case 4*b* and adapted to be operated in a seesaw fashion, a movable contact (not shown) received within the case 4*b* and operated by the operating knob 4*c*, a fixed contact (not shown) adapted for contact with and separation from the movable contact, connecting-side terminals 4*d* drawn out from the fixed contact, and output-side terminals 4*e*.

Each connecting-side terminal 4*d* projects downward from a lower surface of the case 4*b* and a position restricting stepped portion 4*f* is formed halfway. Further, a connecting piece 4*g* whose distal end is thinner than its base portion is formed from the position restricting stepped portion 4*f*. Each output-side terminal 4*e* is formed of a Faston terminal so as to permit Faston connection to an external electronic device (not shown).

On a lower surface side of the bracket 1 is formed an opening 1*b*, in which are disposed the inlet terminals 3 extended from the insulating base 2 of the AC inlet and are also disposed the connecting-side terminals 4*d* of the AC switch 4. A plurality of connecting strips 5 each formed of an electrically conductive metallic strip such as steel or brass strip are connected between the inlet terminals 3 and the connecting-side terminals 4*d*. Connecting holes 5*a* formed in the connecting strips 5 and the connecting pieces 4*g* of the connecting-side terminals 4*d* are connected with each other, whereby the inlet terminals 3 and the AC switch 4 are connected together electrically.

In this case, since the inlet terminals 3 are respectively provided with the position restricting stepped portions 3*d* and the connecting-side terminals 4*d* of the AC switch 4 are also respectively provided with the position restricting stepped portions 4*f*, the connecting strips 5 are restricted their positions by the position restricting stepped portions 3*d* and 4*f* and can thereby be installed so as to be generally parallel to the plane of the opening 1*b* of the bracket 1, i.e., the plane of an insulating cover to be described later. Thus, the connecting strips 5 can be installed stably and it is possible to ensure the reliability of connection.

Moreover, within the opening 1*b* of the bracket 1 are integrally provided a pair of holding portions 1*c* for holding the connecting strips 5 respectively, and when the connecting strips 5 are installed for connection with the connecting pieces 3*b* of the connecting terminals 3 and also for connection with the connecting pieces 4*g* of the connecting-side terminals 4*d* of the AC switch, the holding portions 1*c* come into abutment against lower surfaces of the connecting strips 5, so that the connecting strips are held firmly and the mounting stability and the reliability of connection are improved.

The inlet terminals 3 are each provided with the flexible strip-like arm portion 3*c* and the presence of the arm portion 3*c* can afford flexibility in the connection between each connecting strip 5 and each inlet terminal 3, so, for example, even in the event the connecting pin 3*a* is wrenched when an attachment plug for the supply of an alternating current from an external power supply (not shown) is inserted, the arm portion 3*c* can bend following the wrenched motion, whereby each inlet terminal 3 can be prevented from being damaged.

Each connecting strip 5 is formed with a bent portion 5*b* bent in a generally U shape in the thickness direction of the connecting strip at a position intermediate between the connecting holes 5*a* which are connected with the connecting pieces 3*b* of the inlet terminals 3 and also with the connecting pieces 4*g* of the connecting-side terminals 4*d* in the AC switch 4. Further, the bent portion 5*b* is crushed thin at the bottom and the vicinity thereof so as to become thinner than the thickness of the connecting strip to form a thin-wall portion 5*c*.

In the case where the material of the inlet terminals 3 and that of the connecting-side terminals 4*d* of the AC switch 4 are different from the material of the connecting strips 5, a stress is imposed on the connection due to a difference in thermal expansion coefficient in a power ON condition, but the presence of the bent portions 5*b* permits longitudinal expansion and contraction of the connecting strips 5, so that the connection between each inlet terminal 3 and each connecting-side terminal 4*d* of the AC switch 4 can be prevented from being damaged by the stress.

Moreover, since the bottom of the U-shaped bent portion 5*b* and the vicinity thereof are crushed thinner than the thickness of each connecting strip 5 and so as to expand also in the strip thickness direction (not shown), to form the thin-wall portion 5*c*. Deflection of the thin-wall portion 5*c* makes the connecting strip 5 easier to expand and contract in the longitudinal direction. In addition, since the thin-wall portion 5*c* is formed so as to expand also in the strip thickness direction, it is possible to suppress the generation of heat when an electric current flows through the thin-wall portion 5*c*.

Further, since the connecting strips 5 are each provided with the U-shaped bent portion 5*b*, it is possible to eliminate the occurrence of a stress at the time of installing the connecting strips 5 for connection with the inlet terminals 3 and the connecting-side terminals 4*d* of the AC switch 4.

An insulating cover 6 formed in a lid shape using an insulating material such as a synthetic resin is attached to the opening 1*b* of the bracket 1 so as to cover the connecting strips 5. The insulating cover 6 is integrally formed with a long projecting wall 6*a* for insulation which projects to the opening 1*b* side of the bracket 1. The projecting wall 6*a* is formed so as to be positioned between the connecting strips 5 when the insulating cover 6 is attached to the opening 1*b* of the bracket 1.

Since the projecting wall 6*a* for insulation is formed on the insulating cover 6, it is possible to prevent the occurrence of such problems as short-circuiting of the connecting strips 5 with each other and insulation degradation which are caused by external vibrations and shocks or the deposition of dust.

The insulating cover 6 is formed with an output-side terminal receptacle portion 6*d* comprising a pair of windows 6*b* and a wall portion 6*c* which surrounds the windows 6*b*. The output-side terminal receptacle portion 6*d* is formed so as to be positioned on the lower surface side of the AC switch receptacle portion 1*a* in the bracket 1. In the output-side terminal receptacle portion 6*d* are disposed the output-side terminals 4*e*. In this embodiment, the output-side terminals 4*e* are formed of Faston terminals, whereby the connection to external electronic devices (not shown) can be done easily.

Further, since the output-side terminal receptacle portion 6*d* defined by the wall portion 6*c* is formed in the insulating cover 6, a connecting pin (not shown) of the wire harness to be connected is guided by the wall portion 6*c*, whereby the output-side terminals (Faston terminals) 4 of the AC switch 4 are prevented from wobbling.

Although in the above embodiment the insulating base 2 of the AC inlet is integral with the bracket 1, the present invention is not limited thereto, but the insulating base 2 may be formed as a separate member like the AC switch 4. Also in this case there can be obtained the same effects as in the above embodiment.

Also as to the case 4*b* of the AC switch 4, it may be formed integrally with the bracket 1.

In the switch device with AC inlet according to the present invention, as set forth above, a connecting strip for electric connection between an AC inlet and an AC switch is formed using a flat metallic strip, and a bent portion is formed at an intermediate position of the connection between each inlet terminal and each connecting-side terminal in the AC switch, so that, even when a stress is imposed on the connection due to a difference in thermal expansion coefficient in a power ON condition, the connecting strip permits longitudinal expansion and contraction, thus making it possible to prevent the connection between the inlet terminal and the connecting-side terminal in the AC switch from being damaged by the stress.

In addition, the bent portion is formed by bending the connecting strip in a generally U shape in the strip thickness direction and longitudinal expansion and contraction of the connecting strip are allowed by the generally U-shaped bent portion. Such a simple structure permits longitudinal expansion and contraction of the connecting strip.

Moreover, since the bottom of the generally U-shaped bent portion and the vicinity thereof are formed as a thin-wall portion thinner than the thickness of each connecting strip, longitudinal expansion and contraction of the connecting strip can be allowed easily.

Further, since the bracket is formed with holding portions which come into abutment against the lower sides of the connecting strips, the connecting strips can be held firmly and the mounting stability and the reliability of connection are improved.

What is claimed is:

1. A switch device comprising:

an AC inlet having a connecting pin for AC input and an inlet terminal for connection;

an AC switch having a connecting-side terminal and an output-side terminal;

a metallic connecting strip for electrically connecting the inlet terminal of the AC inlet and the connecting-side terminal of the AC switch with each other; and a bracket with the AC inlet and AC switch attached thereto, wherein the connecting strip is formed of a flat metallic strip and has a bent portion at an intermediate position of the connection between the inlet terminal and the connecting-side terminal of the AC switch.

2. A switch device according to claim 1, wherein the bent portion of the connecting strip is bent in a generally U shape in a thickness direction of the connecting strip to permit longitudinal expansion and contraction of the connecting strip.

3. A switch device according to claim 2, wherein a bottom of the generally U-shaped bent portion of the connecting strip and a vicinity thereof are formed thin to provide a thin-wall portion.

4. A switch device according to claim 1, wherein the bracket is formed with a holding portion for abutment against the connecting strip to hold the connecting strip.

* * * * *